United States Patent [19]

Vidal

[11] Patent Number: 4,735,553

[45] Date of Patent: Apr. 5, 1988

[54] STRAIGHT PERISTALTIC PUMP FOR CONVEYING CONCRETE OR THE LIKE

[76] Inventor: Lucien Vidal, Domaine de la Pimpine, 33360 Latresne, France

[21] Appl. No.: 856,662

[22] Filed: Apr. 25, 1986

[30] Foreign Application Priority Data

Apr. 30, 1985 [FR] France ..... 85 06583

[51] Int. Cl.[4] ..... F04B 43/08

[52] U.S. Cl. ..... 417/33; 417/477

[58] Field of Search ..... 417/474–477, 417/33, 53

[56] References Cited

U.S. PATENT DOCUMENTS

| | | | |
|---|---|---|---|
| 2,865,303 | 12/1958 | Ferrari et al. | 417/477 X |
| 3,138,111 | 6/1964 | Kling et al. | 417/477 X |
| 3,582,234 | 6/1971 | Isreali et al. | 417/477 X |
| 3,628,891 | 12/1971 | Kassel | 417/53 |
| 3,712,762 | 1/1973 | Kenney | 417/477 |
| 3,758,239 | 9/1973 | Hrdina | 417/477 |
| 3,937,598 | 2/1976 | Stannow et al. | 417/477 |

FOREIGN PATENT DOCUMENTS

| | | | |
|---|---|---|---|
| 577378 | 6/1959 | Canada | 417/477 |
| 2162942 | 12/1971 | Czechoslovakia . | |
| 3327669 | 7/1985 | Fed. Rep. of Germany . | |
| 8401925 | 9/1985 | France . | |
| 53-122117 | 10/1978 | Japan | 417/477 |
| 57-108487 | 7/1982 | Japan | 417/477 |

*Primary Examiner*—John J. Vrablik
*Assistant Examiner*—Ted Olds
*Attorney, Agent, or Firm*—Poms, Smith, Lande & Rose

[57] ABSTRACT

This invention relates to a straight peristaltic pump for conveying concrete or the like, comprising a straight hose adapted to be elastically flattened and extending between a base and pressure rollers; the rollers are mounted idly about transverse pins supported by rollers in abutment on runways; the pins connect two endless chains meshing with two pairs of toothed wheels. According to the invention, an inclined ramp of the runways connects their upstream circular part to their straight part and at least one counter gear supported by the frame meshes with each chain in the zone of connection of the ramp with said straight part.

17 Claims, 2 Drawing Sheets

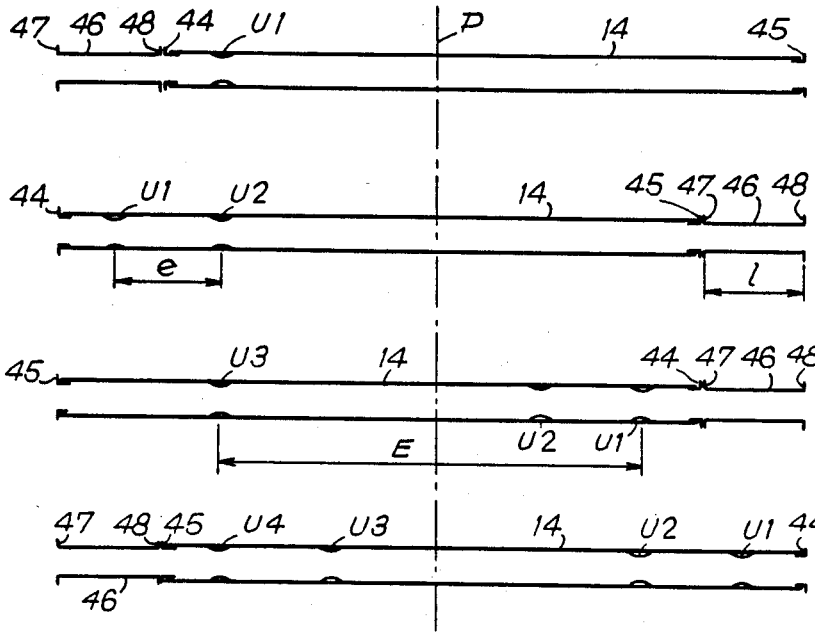
Fig. 4A
Fig. 4B
Fig. 4C
Fig. 4D
Fig. 5
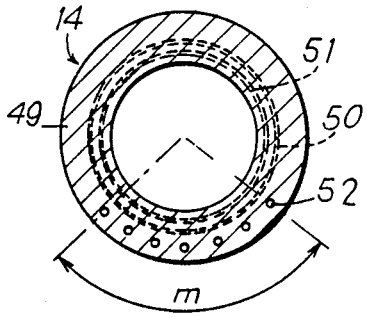
Fig. 6
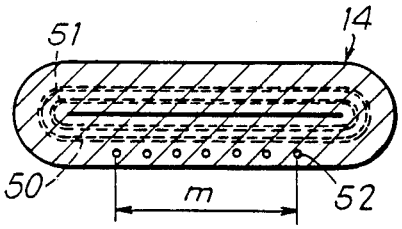
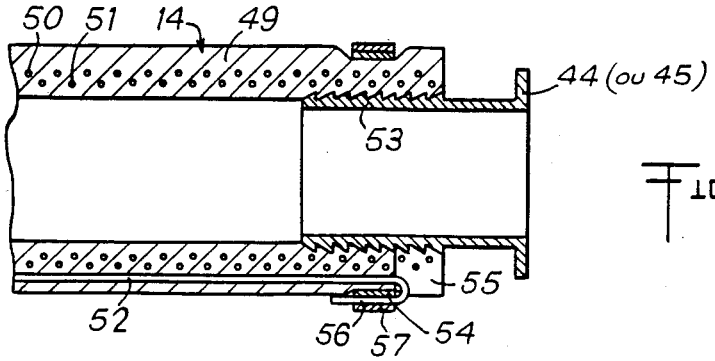
Fig. 7

STRAIGHT PERISTALTIC PUMP FOR CONVEYING CONCRETE OR THE LIKE

The present invention relates to a straight peristaltic pump for conveying concrete or other heterogeneous, granular and /or abrasive fluid.

A pump of this type for conveying generally corrosive homogeneous liquids is known. It comprises a straight pumping hose adapted to be elastically flattened and extending between a substantially plane base of a fixed frame and pressure rollers. This frame comprises two plates of which the edges constitute runways on which abut rollers supporting transverse pins about which the pressure rollers are idly mounted. The plates also support two end shafts of which one is driving and which are coupled to two pairs of toothed wheels located inside the plates. These toothed wheels mesh with two endless chains connecting, by their links, the said pins of the rollers.

Opposite the base, the rollers follow one another in an active path presenting, relatively to a linear portion parallel to said base, so that these rollers squeeze the hose and, on progressing, deliver a fluid:

upstream, an engaging portion in the form of a tangential arc of circle, and downstream, a disengaging portion also in the form of a tangential arc of circle.

Attempts have been made to use this known pump for conveying concrete; it has appeared that the efforts to be furnished periodical so that each roller flattens the hose and squeezes it, are considerably high, given that this hose contains concrete. Also, the circular path is poorly adapted to this work, as the concrete plugs up the bends.

On the other hand, when the downstream roller maintains the hose crushed at its mobile location and the upstream roller flattens said hose at its own mobile location, the inner volume of this portion of hose included between the two rollers decreases and, consequently, the concrete contained in this portion activates, in its flow down stream, a reflux upstream whenever a roller engages, such reflux being directed in the passage existing in the hose opposite the engaging roller and which is constantly reduced until total obturation by crushing is obtained. This results in an intense wear of the inner wall of the hose in the engaging zone, on the one hand, by abrasion and, on the other hand, by laceration due to gravel which is pinched and taken along in this zone.

When the hose is worn in the engaging zone, it must, of course, be replaced although it is still in good condition outside this zone.

Furthermore, the hose is made of a thick elastomer coating transverse reinforcements, which are preferably inclined and crossed. This reinforced hose is relatively flexible in its longitudinal part in contact with the rollers; but, under the thrust effort of the latter, the longitudinal part of the hose in contact with the base extends, slides and wears out. It is then necessary to limit the operating pressure of the pump and to place said hose under tension; moreover, elongation of the inner wall of the hose accentuates the effects of laceration of the gravel.

It is an obiect of the present invention to overcome these drawbacks and thus to propose improvements in the straight peristaltic pump mentioned hereinabove.

In accordance with the invention, in order to take over a new charge of concrete progressively and without jerks, and to drive it regularly towards the straight portion of the path, the engaging portion of this path converges towards the base and downstream, this portion being determined, on the one hand, by a cam of the runways connecting their upstream circular part to their straight part and, on the other hand, by at least one counter gear supported by the frame and meshing with each chain in the zone of connection of the cam with the straight part of the connected runway.

Each runway comprises a disengaging cam cooperating with at least one counter gear of the connected chain, these disengaging cams and their counter gears being disposed symmetrically with the engaging cams and their own counter gears.

According to a particularly advantageous embodiment, each cam is a straight inclined ramp tangential to the circular part of the corresponding runway and connected to the straight part of this runway.

Each inclined ramp is preferably connected to the straight part of the runway by another inclined ramp having a lesser inclination which, when it follows the engaging ramp, is a finishing ramp provoking crushing of the hose and, when it precedes the disengaging ramp, is an activating ramp promoting opening of the hose for delivery.

In this way, the efforts are applied progressively and without jerks on each roller arriving in the engagement zone. The driving power is then regularized under better conditions and makes it possible to obtain a higher operating pressure with equipment which is more robust and more reliable.

Such progressivity being acquired, the reduction in wear by abrasion and laceration is obtained by the fact that, in accordance with the invention, the distance from the engaging cam to the disengaging cam of each runway is such, compared with the distance separating two consecutive rollers, that the passages defined by the hose clamped opposite the two rollers, when the latter are placed symmetrically with respect to the median plane of the straight portions of the runways, present the same section of which the height is substantially equal to the size of the largest piece of gravel.

In fact, upon reduction in volume of the portion of hose between the two rollers, the reflux is considerably attenuated by the passages which appear symmetrically in said hose beneath these two rollers and the concrete is guided downstream under the thrust of the upstream roller, not tending, by reason of its high viscosity, to reflux upstream. Moreover, the gravel escapes easily from the upstream passage under the thrust of the upstream roller. Laceration is therefore considerably reduced and wear by abrasion attenuated.

Safety means must, of course, be operable if too large a piece of gravel is jammed; this result is obtained by the fact that, according to the invention, the runways are constituted by the edges of two plates shaped as trapeziums of which the tops of their large bases remote from the base are rounded, these plates between which the rollers extend being rigidly braced by crosspieces in order to form a chassis adapted to be dismounted with respect to the fixed frame and said plates supporting two end shafts and at least two intermediate shafts, on which are respectively fitted the toothed drive wheels and the counter gears, which wheels and gears are located outside the plates. Moreover, the chassis is guided in translation perpendicularly to the base, along columns fast with the frame, pressure rollers, such as elastomer blocks, applying elements of the chassis, such as the crosspieces, against stops of the frame, such as shoulders of the columns, to maintain this chassis elastically in pumping position. A detection member, such as a micro-contact, is placed on the path of removal of the chassis relatively to the base, this member acting on the control unit of the pump if it is stressed.

In order to distribute wear over virtually the whole length of the hose and to increase its life, according to the invention, one of the ends of this hose extends up to the vicinity of the engaging zone of crushing and is extended by at least one extension to form an assembly of which the ends are symmetrical relatively to the median plane of the straight portions of the runways, with the result that, by transferring the extension from one end of the hose to the other and by turning the assembly over, at least four different zones of said hose are brought opposite the crushing zone.

The length of the extension is shorter than the distance from the zone of crushing to the median plane of the straight portions of the runways.

Finally, in order to attenuate outer wear of the hose on the base, to increase the operating pressure, to avoid tensioning of the elastomer hose proper, and to reduce the effects of laceration of the gravel due to the elongation of the inner wall of the hose, said hose also comprises, according to the invention, longitudinal reinforcements forming a lap which extends in the vicinity of the base in a limited angular sector, the lap of these reinforcements being between 5 and 35% of the circumferential evolute of the hose and preferably equal to 10%.

The ends of the longitudinal reinforcements of the hose are advantageously fixed on the end connection members of this hose; each longitudinal reinforcement end is bent through an end slot in the hose and clamped between two concentric collars mounted, the first, to fix the hose on its connection and, the second, to fix the bent ends of reinforcements against the first.

The means of the invention set forth hereinabove make it possible to attain the objective, namely to overcome the drawbacks of the straight peristaltic pumps with arcuate engaging and disengaging paths, whilst conserving the advantages thereof.

In this way, the hose remaining "straight", any charge in direction of the concrete during pumping thereof is eliminated, which avoids the segregation of the concrete and the formation of plugs.

Cleaning, replacement and inspection of the hose are facilitated.

The hose may comprise a very thick wall which, by its inherent elasticity, may resume its full circular section after having been crushed by the rollers, this avoiding the use of a vacuum pump, which is necessary for peristaltic pumps with a semi-circular cage.

The invention will be more readily understood on reading the following description with reference to the accompanying drawings, in which:

FIGS. 4A to 4D are schematic longitudinal sections showing the hose of the pump carrying out a first improvement according to the invention which concerns the distribution of the zones of wear.

FIGS. 5 and 6 are transverse sections through the hose showing a second improvement according to the invention which concerns the longitudinal reinforcements.

FIG. 7 is a section through the connected end of the hose, showing the fixation of the longitudinal reinforcements.

Figures 1, 2, 2A, 3:
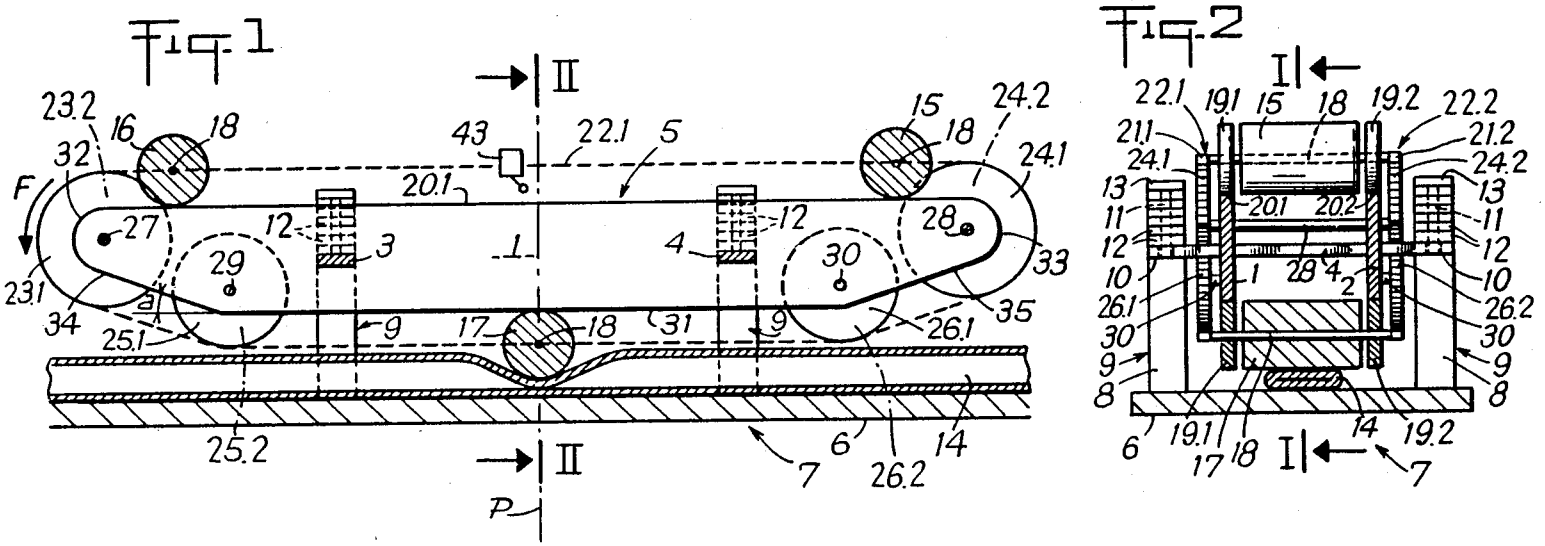
FIG. 1 is a schematic elevation-section taken along line I—I of FIG. 2 showing an embodiment of the pump according to the invention.
FIG. 2 is a transverse section taken along line II—II of FIG. 1.
FIG. 2A is a view similar to the left half of FIG. 2, illustrating a variant embodiment.
FIG. 3 is a diagram illustrating the improvements of the invention applied to a variant of the embodiment mentioned hereinabove.

Referring now to the drawings, and firstly to FIGS. 1 and 2, the straight peristaltic pump comprises two plates 1 and 2 braced by two crosspieces 3 and 4 to which they are rigidly fixed in order to form a dismountable chassis 5. The chassis is guided in translation perpendicularly to a substantially plane base 6 belonging to a fixed frame 7 not shown. To this end, the base 6 is fast with the shaft 8 of four columns 9 extended, beyond shoulders 10, by guide rods 11 on which are fitted the ends of the crosspieces 3 and 4 projecting from the plates. These ends of the crosspieces are elastically applied against the shoulders 10 by elastic suspensions, such as elastomer blocks 12 or any other equivalent means: springs, pneumatic jacks, . . . abutting against terminal stops 13 of said rods.

On base 6 there rests a straight pumping hose 14 adapted to be elastically flattened. This hose may be constituted by a relatively thick rubber, as it must convey concrete under pressure and pass by elastic return from a flattened section for obturation (FIGS. 1, 2 and 6) to a circular section for transport (FIGS. 1 and 5).

Chassis 5 supports pressure rollers 15, 16, 17 extending transversely between plates 1 and 2. Each of the rollers 15 to 17 is mounted idly about a pin 18 supported by two rollers 19.1 and 19.2 resting on runways 20.1 and 20.2 constituted by the edges of plates 1 and 2. The projecting ends 21.1 and 21.2 of the pins of the three rollers are fixed to links of two endless chains 22.1 and 22.2, which links are selected for said rollers to be equidistant from one another. Chains 22.1 and 22.2 mesh on the one hand with two pairs of end toothed wheels 23.1, 23.2 and 24.1, 24.2, on the other hand, with two pairs of counter gears 25.1, 25.2 and 26.1, 26.2. Wheels 23 and 24 are fixed on shafts 27 and 28 supported by plates 1 and 2 of the chassis, one of these shafts being driving and connected to a device not shown, for driving in rotation in the direction of arrow F. The counter gears 25 and 26 are fixed on shafts 29 and 30 aligned and supported in overhang by said plates or binding pieces.

Chains 22.1, 22.2 and runways 20.1, 20.2 are equidistant. It is very important to note that the plates are shaped as trapeziums of which the small base 31, lying near base 6 and hose 14 which abuts thereon, is connected to the end rounded parts 32, 33 of the large base by cams 34, 35. These cams are adapted to determine respectively the engaging portion 36 and the disengaging portio 37 located at the ends of the straight pumping portion 38 of the active path of the rollers 15 to 17. Consequently, cams 34 are shaped in order to master the progressivity of engagement and their shape which is generally sloping depends on the law chosen.

In practice and according to the embodiment illustrated in FIG. 1, these engaging cams 34 are inclined ramps tangential to the rounded parts 32 and joined to the straight parts 31. In the example shown, they form an angle "a" with these parts 31, which angle is preferably equal to 20° F.; however, it may vary between 15° and 40°. The counter gears 25.1 and 25.2 are then located at the connection of ramps 34 with the straight parts 31. In addition, the drawing clearly shows that the disengaging cams 35 extend symmetrically to the engaging cams 34 with respect to the median plane P.

According to the variant shown in FIG. 3, the inclined engaging ramps 34 are connected to the straight parts 31 by inclined finishing ramps 39 allowing hose 14 to be crushed. The same may moreover apply for the inclined disengaging ramps 35 which are then preceded by inclined activation ramps 40 promoting the opening of hose 14 for delivery of the concrete. In any case, in the example chosen, the finishing or crushing ramps 39 form an angle "b" with the straight parts 31 and the activation ramps 40 are advantageously symmetrical with respect to the preceding ones relatively to plane P. The angle b is between 3° and 15° and preferably equal to 5°. In this variant according to FIG. 3, the counter gears 25.1 and 25.2 lie in the zone of connection of ramps 34 and 35 with ramps 39 and 40 respectively.

In this way, rollers 15 to 17 driven by chains 22.1 and 22.2 and guided by runways 20.1 and 20.2 follow opposite hose 14 an active pumping path which, by reason of the existence of counter gears 25 and 26 under the chains and of ramps 34 and 35 (possibly with 39 and 40) on the runways, present, relatively to the straight pumping part 38 (FIG. 3):

upstream, a progressive, regular engaging portion 36,
and downstream, a progressive, regular disengaging portion 37, thanks to which portions a perfectly mastered progressivity is obtained in order to engage, through the wall of concrete, and in order to extract another roller from said section, respectively.

The downstream ramps 35 and 40 are of course useful, especially when the chains 22 are driven in reverse for disengaging the hose 14.

Consequently, the driving power is regularized under better conditions and the flow of the concrete obtained with a considerable attenuation of the jerks.

Such attenuation is improved and wear of hose 14 considerably reduced at engagement by employing the improvement according to FIG. 3.

According to this improvement, the distance "d" of the two cams or ramps 34 and 35 is such that, compared to distance "D" separating two consecutive rollers (16 and 17 for example), the passages 41 and 42 defined by hose 14 clamped opposite two rollers, when the latter are disposed symmetrically with respect to plan P, present the same free section and, from this position, upstream passage 41 narrows whilst downstream passage 42 enlarges.

In the known straight pumps wherein the engaging and disengaging portions of the active pumping path are exclusively circular, the rollers lying in the same position as before clamp the hose, simultaneously ensuring seal at the ends of the portion of hose thus isolated; by engaging their crushing stroke, these rollers reduce the volume of this section from which the concrete can escape only by infiltrating between the folds in contact with the flattened ends of said section and by lacerating by its gravel the inner wall of the hose at these spots.

According to the improvement of FIG. 3, upon final variation of the volume of the section of hose clamped between the rollers in symmetrical positions, the excess concrete may flow both downstream and upstream through passages 41 and 42. In fact, if the downstream pressure is not too high, the concrete does not tend, by reason of its high viscosity, to reverse its direction of flow to return upstream through these passages. On the contrary, by inertia and since, on the one hand, it does not encounter any noteworthy resistance in said passages and, on the other hand, the downstream passage 42 enlarges whilst the upstream passage 41 narrows, the concrete tends to continue its flow downstream or to stagnate momentarily, but not to reflux upstream en masse.

In addition, in the above-mentioned position illustrated in FIG. 3, the equal sections of passages 41 and 42 have a height preferably substantially equal to the size of the largest piece of gravel. In this way, it is rare for gravel to be jammed in passage 41 and to lacerate the inner wall of hose 14 in the course of final penetration of roller 16 and consecutive crushing of said hose.

In the straight pumping part 38 of the active path, the roller which follows this part maintains hose 14 crushed and, on rolling, delivers the concrete from the corresponding section. In principle, segregation of the gravel is not produced and the latter then accompanies the pasty mass in front of the roller. However, it sometimes happens that a piece of gravel jams between the two folds of the hose. Chassis 5 then rises against the action of the elastic suspensions 12, especially if the gravel is large, in order to avoid laceration of the inner wall of said hose and, after passing over the gravel, returns to the position of crushing in which crosspieces 3, 4 are supported against shoulders 10 of the columns, in which position tightness of the hose is achieved in the zones crushed by the rollers.

If chassis 5 is raised too much and/or if raising lasts too long, a safety means must operate and possibly even stop the pump. To this end, a detection member 43 (FIG. 1), such as a microcontact, is mounted on the fixed frame 7 for its mobile element to be stressed by chassis 5 during raising thereof beyond a certain limit; this micro-contact is inserted in the safety circuit of the control unit of the pump.

In any case, wear of hose 14 by abrasion and laceration is not uniform and its maximum is localized in zone U (FIG. 3) corresponding to crushing at the end of engagement.

Such wear must therefore be distributed over the largest extent of the hose possible in order to increase useful life thereof. The means employed to this end are shown in FIGS. 4A to 4D and enable four zones of wear U.1 to U.4 to be distributed on said hose.

Hose 14 is provided at its ends with connecting flanges 44 and 45 enabling it to be integrated in the circuit of the installation. It cooperates with an extension 46 of which the end flanges 47 and 48 are capable of being selectively connected to the flange 44 or 45 of the hose to form an assembly of which the two flanges remaining free must then be fixed on those of the circuit on standby.

This assembly 14, 46 is positioned so that its end flanges are disposed symmetrically with respect to plane P. It is question for example of flanges 45 and 47 in the initial assembly according to FIG. 4A.

Moreover, in this initial assembly, the end flange 44 of hose 14 lies in the vicinity of the zone of wear U (FIG. 3).

The assemblies are then effected in the following manner:

according to FIG. 4A, extension 46 is upstream and its flange 48 is fixed on flange 44 of hose 14; a zone of wear U.1 is then formed;

according to FIG. 4B, extension 46 is displaced downstream and its flange 47 is fixed on flange 45 of hose 14; a second zone of wear U.2 is then formed, spaced apart from the preceding one, U.1, by a distance "e" equal to the length "1" of the extension;

according to FIG. 4C, extension 46 is still downstream, but hose 14 is turned over, with the result that it is now its flange 44 which is fixed on flange 47 of said extension; a third zone of wear U.3 is then formed, spaced apart from the first, U.1, by a distance "E" equal to twice the distance "L" (FIG. 3) which separates zone U from plane P;

according to FIG. 4D, extension 46 returns upstream, hose 14 remaining turned over, and it is consequently flanges 45 and 48 which are fixed against each other; a fourth zone of wear U.4 is then formed, spaced apart from the third, upstream, by distance "e".

In this way, hose 14 is replaced only after wear in four zones U.1 to U.4 distributed over its length. The hose is in that case worn virtually over the whole of its extent, being given that wear by abrasion along the straight part 38 of the path lasts four times longer than in each of the zones U.1 to U.4 by abrasion and laceration.

The distance from zones U.1 and U.2, like that from zones U.3 and U.4, is equal to the length 1 of the extension; the distance from zones U.2 and U.3 is equal to the difference $2L-1$.

Of course, in order that the zones of wear do not overlap, it is desirable that length "1" of the extension be shorter than said distance "L".

Furthermore, and as is clearly shown in FIGS. 5 to 7, the elastomer wall 49 of hose 14 is relatively thick and coats two laps of transverse reinforcements 50 and 51, these reinforcements preferably being metallic and wound in opposite concentric helices.

As indicated hereinbefore, a third lap of reinforcements 52 is advantageously provided. The latter, which are preferably metallic, extend longitudinally and parallel to one another, in order to form a lap located in the vicinity of the base 6 and covering a limited width "m". This width is included between 5 and 35% of the circumferential evolute of the hose with the same radius; it is preferably equal to 10%.

Contrary to what is illustrated in FIGS. 5 to 7, it is obviously an advantage for the inner wall of elastomer to be much thicker than the outer wall, relatively to the three laps of reinforcements, considering that it is mainly the inner wall which is subjected to wear. Furthermore, the lap of longitudinal reinforcements 52 extends outside the two laps of transverse reinforcements 50 and 51, but it is quite obvious that said lap of longitudinal reinforcements could be situated between the two transverse laps or inside thereof.

In any case, each end of hose 14 is fitted with a connecting flange 44 (or 45); in the example shown, this flange projects on a connecting sleeve 53 fitted in the relevant end of the hose and fixed by means of a collar 54.

Under these conditions, the longitudinal reinforcements 52 are stretched and each of their ends is fixed on the corresponding connecting means. In the example shown, slots 55 are made at the end of the hose opposite said reinforcements in order to disengage and catch them; the ends thereof are then bent to form loops 56 covering the collar 54; a second collar 57 is then fitted on these loops and clamped on the first 54 in order to ensure firm and solid fixation of said reinforcements.

The invention is in no way limited to the embodiments described and illustrated hereinabove, and on the contrary, various modifications can be brought thereto without departing from its scope.

In particular, the monolithic condition of the chassis 5, instead of being achieved with the crosspieces 3 and 4, is achieved, as illustrated in FIG. 2A, by the crossshafts 29 and 30; in this case, said shafts 29 and 30 traverse the counter gears 25.1, 25.2, 6.1 and 26.2 respectively and project out thereof; the projecting parts 30A of the shafts are then mounted for pivoting in bearings equipped with elastic rings 12A, replacing the elastic elements 12, said bearings being in this case supported by the columns 9. The advantage with this particular variant is that it enables the ready disconnection of those by simply disengaging the bearings of one of the shafts and by pivoting the chassis about the bearings of the other shaft.

What is claimed is:

1. A straight peristaltic pump for conveying concrete or other heterogeneous, granular and/or abrasive fluid, comprising a straight pumping hose adapted to be elastically flattened extending between a substantially planar base of a fixed frame and a plurality of spaced pressure rollers following one another along an active path on runways of a pair of spaced plates mounted on said frame above said base having cam portions thereon, presenting, between an engaging portion and a disengaging portion of said cam portions, a straight portion each on said plates parallel to the base so that the rollers crush the hose and said cam portions on each of said plates each having a straight part and a circular part disposed at appropriate ends of said straight portions whereby said rollers, when simultaneously contacting said hose and one of said cam portions, progressively vary the opening of said hose to deliver the concrete conveyed by the hose, the rollers being mounted idly about transverse pins which are supported by spaced rollers abutting said runways of the plates and which connect two spaced apart endless chains equidistant from said runways, meshing with two pairs of spaced toothed wheels of which at least one pair is a driving wheel, supported by the frame, wherein, in order to take over a new charge of concrete progressively and without jerks, and to drive it regularly towards the straight portion of said plates defining a straight path, the engaging portion of this path converging toward the base and downstream, this engaging portion being determined, on the one hand, by one of said cam portions of the runways connecting their upstream circular part to their straight part and, on the other hand, by at least one counter gear supported by the frame and meshing with each chain in the zone of connection of the cam portion with the straight part of the connected runway.

2. The pump of claim 1, wherein each disengaging cam portion cooperates with at least one counter gear of the connected chain, these disengaging cam portions and their counter gears being disposed symmetrically with the engaging cam portions and their own counter gears.

3. The pump of claim 1 or 2, wherein the straight portion of each cam portion straight part is a straight inclined ramp tangential to the circular part of the cam portion of the corresponding runway and connected to the straight part of said cam portion of said runway.

4. The pump of claim 3, wherein the inclination of each inclined ramp relative to the corresponding straight part of the cam portion of the runway is between 15° and 40° and preferably equal to 20°.

5. The pump of claim 3, wherein each inclined ramp is connectd to the straight part of the cam portion of said runway by another inclined ramp having a lesser inclination which, when it follows the engaging ramp, is a finishing ramp provoking crushing of the hose and, when it precedes the disengaging ramp, is an activating ramp promoting opening of the hose for delivery.

6. The pump of claim 3, wherein the inclination of each inclined crushing ramp connecting the straight part of the runway to the engaging ramp or activating ramp connecting said straight part to the disengaging ramp is between 3° and 15° and preferably equal to 5°.

7. The pump of claim 2, wherein the distance from the engaging cam portion to the disengaging cam portion of each runway is such, comparatively to the distance separating two consecutive pressure rollers, that the passages defined by the clamped hose opposite to two pressure rollers, when the latter are placed symmetrically with respect to the median plane of the straight portions of the runways, present the same section of which the height is preferably substantailly equal to the size of the largest piece of granular matter in said concrete.

8. The pump of claim 1 wherein the runways are constituted bythe edges of said plates being shaped as trapeziums of which the tops of their large bases remote from the base are rounded, these plates between which the pressure rollers extend being rigidly braced by crosspieces in order to form a chassis adapted to be dismantled with respect to the fixed frame and said plates supporting two end shafts and at least two intermediate shafts, on which are respectively the toothed drive wheels and the counter gears, which wheels and gears lie outside the plates.

9. The pump of claim 1, wherein a chassis supporting the runways, the pressure rollers and the shafts on which are fixed the toothed drive wheels and idly mounted the counter gears is guided in translation perpendicularly to the base, along columns fast with the frame, elastic pressure members disposed between the chassis and said frame in order to maintain this chassis elastically in pumping position.

10. The pump of claim 1, wherein the runways are constituted by the edges of said plates being shaped as trapezium of which the top of their large bases remote from the base are rounded, these plates between which the pressure rollers extend supporting two end shafts on which are fixed the toothed drive wheels and being rigidly braced by two intermediate shafts in order to form a chassis adapted to be dismantled with respect to the fixed frame, the free ends of the intermediate axes about which the counter gears are idly mounted, being pivotally mounted inside bearings equipped with elastic rings and supported by columns, fast with the frame.

11. The pump of claim 1, wherein a detection member is disposed in the path of for acting on the control unit of the pump when stressed.

12. The pump of claim 1, wherein one of the ends of the hose extends up to the vicinity of the engaging zone of crushing and is extended by at least an extension to form an assembly whose ends are symmetrical relatively to the median plane of the straight portions of the runways with the result that, by transferring the extension from one end of the hose to the other and turning the assembly over, at least four different zones of said hose are brought opposite the zone of crushing.

13. The pump of claim 1, wherein the length of the extension is shorter than the distance from the crushing zone to the median plane of the straight portions of the runways.

14. The pump of claim 1 of which the hose comprises, coated in the elastomer which constitutes it, transverse reinforcements, which are preferably inclined, wherein it also comprises longitudinal reinforcements forming a lap which extends near the base in a limited angular sector, and preferably in the elastomer outside at least one of the laps of transverse reinforcements.

15. The pump of claim 1, wherein the width of a lap of longitudinal reinforcement coated in the elastomer of the hose is between 5 and 35% of the circumferential evolute of the hose, and preferably equal to 10%.

16. The pump of claim 1, wherein the ends of the longitudinal reinforcement coated in the elastomer of the hose are fixed on the end connection members of this hose.

17. The pump of claim 1, wherein each end of each longitudinal reinforcement coated in the elastomer of the hose, is bent through an end slot in the hose and clamped between two concentric collars mounted, the first, to fix the hose on its connection and the second, to fix the bent reinforcement ends against the first.

* * * * *